US009636931B2

(12) United States Patent
Sahara et al.

(10) Patent No.: US 9,636,931 B2
(45) Date of Patent: May 2, 2017

(54) PRINTING APPARATUS AND CONTROL METHOD THEREOF

(71) Applicant: CANON KABUSHIKI KAISHA, Tokyo (JP)

(72) Inventors: Akiyoshi Sahara, Funabashi (JP); Tetsuya Edamura, Inagi (JP); Atsushi Takahashi, Tama (JP); Tomofumi Nishida, Yokohama (JP); Toshiyuki Kuroda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/810,826

(22) Filed: Jul. 28, 2015

(65) Prior Publication Data

US 2016/0052308 A1 Feb. 25, 2016

(30) Foreign Application Priority Data

Aug. 19, 2014 (JP) ..... 2014-166999

(51) Int. Cl.
*B41J 2/165* (2006.01)
*B41J 13/00* (2006.01)
*B41J 11/00* (2006.01)

(52) U.S. Cl.
CPC ..... *B41J 11/0095* (2013.01); *B41J 2/16526* (2013.01); *B41J 2002/16573* (2013.01)

(58) Field of Classification Search
CPC B41J 13/0009; B41J 11/0095; B41J 2/16526; B41J 2002/16573
USPC ..... 347/16
See application file for complete search history.

(56) References Cited

U.S. PATENT DOCUMENTS 6,702,274 B1 * 3/2004 Otsuka ..... B41J 13/0009 271/10.01
7,377,611 B2 * 5/2008 Shimoyama ..... B41J 13/0009 347/16
7,562,961 B2 * 7/2009 Inoue ..... B41J 2/16585 347/104
2004/0160475 A1 * 8/2004 Satoh ..... B41J 2/155 347/36
2005/0078145 A1 * 4/2005 Inoue ..... B41J 2/16585 347/31
2005/0271437 A1 12/2005 Edamura et al.
(Continued)

FOREIGN PATENT DOCUMENTS

JP 2009-241261 A 10/2009

OTHER PUBLICATIONS

U.S. Appl. No. 14/719,156, filed May 21, 2015. Applicant: Noriyuki Sugiyama, et al.

*Primary Examiner* — Stephen Meier
*Assistant Examiner* — Alexander D Shenderov
(74) *Attorney, Agent, or Firm* — Fitzpatrick, Cella, Harper & Scinto

(57) ABSTRACT

A printing apparatus comprises a maintenance unit configured to execute a maintenance operation between a completion of printing on a preceding sheet serving as the printing sheet fed from a stacking unit first and a start of printing on a succeeding sheet serving as the printing sheet fed from the stacking unit next, and a determination unit configured to determine whether to execute the maintenance operation, wherein the determination unit determines, based on a feeding method of the succeeding sheet, whether to execute the maintenance operation.

9 Claims, 7 Drawing Sheets

| EXECUTION TIMING | | TYPE OF PRELIMINARY DISCHARGE |
|---|---|---|
| DURING PRINTING OPERATION | EACH TIME FIRST TIME HAS ELAPSED SINCE FIRST PRELIMINARY DISCHARGE WAS EXECUTED LAST TIME | FIRST PRELIMINARY DISCHARGE |
| | EACH TIME SECOND TIME HAS ELAPSED SINCE FIRST OR SECOND PRELIMINARY DISCHARGE WAS EXECUTED LAST TIME | SECOND PRELIMINARY DISCHARGE |

(56) References Cited

U.S. PATENT DOCUMENTS

| | | | | |
|---|---|---|---|---|
| 2006/0164459 | A1* | 7/2006 | Mihara | B41J 2/165<br>347/22 |
| 2009/0073211 | A1* | 3/2009 | Imoto | B41J 11/0005<br>347/16 |
| 2011/0205273 | A1* | 8/2011 | Hibino | B41J 2/04581<br>347/10 |
| 2011/0261096 | A1* | 10/2011 | Watanabe | B41J 2/16526<br>347/9 |

* cited by examiner

FIG. 6

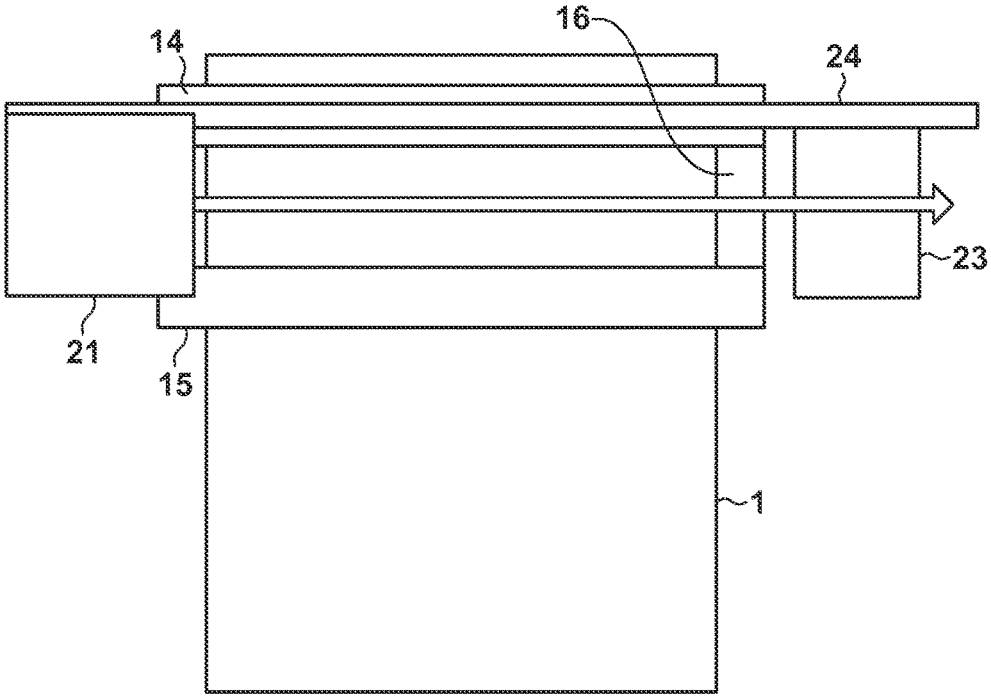

FIG. 7

| WHEN FEEDING SUCCEEDING SHEET, OVERLAPPING STATE IS | BEFORE STARTING PRINTING OPERATION, PRELIMINARY DISCHARGE IS |
|---|---|
| FORMED | NOT EXECUTED |
| NOT FORMED | EXECUTED |

FIG. 8

| EXECUTION TIMING | | TYPE OF PRELIMINARY DISCHARGE |
|---|---|---|
| DURING PRINTING OPERATION | EACH TIME FIRST TIME HAS ELAPSED SINCE FIRST PRELIMINARY DISCHARGE WAS EXECUTED LAST TIME | FIRST PRELIMINARY DISCHARGE |
| | EACH TIME SECOND TIME HAS ELAPSED SINCE FIRST OR SECOND PRELIMINARY DISCHARGE WAS EXECUTED LAST TIME | SECOND PRELIMINARY DISCHARGE |

FIG. 10

| NON-PRINTING TIME | BEFORE STARTING PRINTING OPERATION, PRELIMINARY DISCHARGE IS |
|---|---|
| Tn ≤ Ta | NOT EXECUTED |
| Tn > Ta | EXECUTED |

FIG. 11

| WHEN FEEDING SUCCEEDING SHEET, OVERLAPPING STATE IS | CARRIAGE AND CAP ARE | BEFORE STARTING PRINTING OPERATION, PRELIMINARY DISCHARGE IS |
|---|---|---|
| FORMED | AWAY FROM EACH OTHER | NOT EXECUTED |
| | CLOSE TO EACH OTHER | EXECUTED |
| NOT FORMED | — | EXECUTED |

FIG. 12

| WHEN FEEDING SUCCEEDING SHEET, OVERLAPPING STATE IS | TIME ELAPSED SINCE FIRST PRELIMINARY DISCHARGE WAS EXECUTED LAST TIME | BEFORE STARTING PRINTING OPERATION, PRELIMINARY DISCHARGE IS |
|---|---|---|
| FORMED | FIRST TIME (EXCLUSIVE) | NOT EXECUTED |
| | FIRST TIME (INCLUSIVE) | EXECUTED |
| NOT FORMED | — | EXECUTED |

FIG. 13

| EXECUTION TIMING | | TYPE OF PRELIMINARY DISCHARGE |
|---|---|---|
| DURING PRINTING OPERATION | EACH TIME SECOND TIME HAS ELAPSED SINCE FIRST OR SECOND PRELIMINARY DISCHARGE WAS EXECUTED LAST TIME | SECOND PRELIMINARY DISCHARGE |

PRINTING APPARATUS AND CONTROL METHOD THEREOF

BACKGROUND OF THE INVENTION

Field of the Invention

The present invention relates to a printing apparatus which prints images on a plurality of sheets and, more particularly, a printing apparatus which executes a maintenance operation between the completion of printing on a preceding sheet and the start of printing on a succeeding sheet.

Description of the Related Art

Japanese Patent Laid-Open No. 2009-241261 describes an inkjet printing apparatus which executes preliminary discharge immediately before the start of printing each time images are printed on a plurality of sheets.

The apparatus described in Japanese Patent Laid-Open No. 2009-241261, however, executes preliminary discharge by moving a printhead to a preliminary discharge acceptable cap, resulting in moving the printhead to execute preliminary discharge each time the images are printed on the plurality of sheets. This poses a technical problem that a time required to complete printing the images on the plurality of sheets prolongs.

The main purpose of executing preliminary discharge immediately before the start of printing is to prevent a discharge failure that may occur due to the fact that ink discharge by a printing operation is not performed while discharging the preceding sheet and feeding the succeeding sheet. Therefore, if it is considered that a time required to discharge the preceding sheet and feed the succeeding sheet is short, and no discharge failure occurs even if ink discharge is not performed during that time, no problem is posed even if preliminary discharge is not executed immediately before the start of printing.

SUMMARY OF THE INVENTION

The present invention has been made in consideration of the above-described problems and provides a printing apparatus capable of shortening a time required to complete printing images on a plurality of sheets without causing any discharge failure.

According to the first aspect of the present invention, there is provided a printing apparatus comprising: a maintenance unit configured to execute a maintenance operation between a completion of printing on a preceding sheet serving as the printing sheet fed from a stacking unit first and a start of printing on a succeeding sheet serving as the printing sheet fed from the stacking unit next; and a determination unit configured to determine whether to execute the maintenance operation, wherein the determination unit determines, based on a feeding method of the succeeding sheet, whether to execute the maintenance operation.

According to the second aspect of the present invention, there is provided a printing apparatus comprising: a maintenance unit configured to execute a maintenance operation between a completion of printing on a preceding sheet serving as the printing sheet fed from a stacking unit first and a start of printing on a succeeding sheet serving as the printing sheet fed from the stacking unit next; a determination unit configured to determine whether to execute the maintenance operation; and an estimation unit configured to estimate a non-printing time from the completion of printing on the preceding sheet to the start of printing on the succeeding sheet, wherein the determination unit determines, based on the non-printing time estimated by the estimation unit, whether to execute the maintenance operation.

According to the third aspect of the present invention, there is provided a control method of a printing apparatus comprising: a maintenance step of executing a maintenance operation between a completion of printing on a preceding sheet serving as the printing sheet fed from a stacking unit first and a start of printing on a succeeding sheet serving as the printing sheet fed from the stacking unit next; and a determination step of determining, based on a feeding method of the succeeding sheet, whether to execute the maintenance operation.

According to the fourth aspect of the present invention, there is provided a control method of a printing apparatus comprising: a maintenance step of executing a maintenance operation between a completion of printing on a preceding sheet serving as the printing sheet fed from a stacking unit first and a start of printing on a succeeding sheet serving as the printing sheet fed from the stacking unit next; an estimation step of estimating a non-printing time from the completion of printing on the preceding sheet to the start of printing on the succeeding sheet; and a determination step of determining, based on the non-printing time estimated by the estimation step, whether to execute the maintenance operation.

Further features of the present invention will become apparent from the following description of exemplary embodiments with reference to the attached drawings.

BRIEF DESCRIPTION OF THE DRAWINGS

FIG. 6 is a view for explaining preliminary discharge when a carriage is away from a cap;

FIG. 7 is a table showing summarized conditions for executing preliminary discharge before starting the printing operation of the succeeding sheet according to the first embodiment;

FIG. 8 is a table showing the types of preliminary discharge and execution timings according to the first embodiment;

FIG. 10 is a table showing summarized conditions for executing preliminary discharge before starting the printing operation of a succeeding sheet according to the second embodiment;

FIG. 11 is a table showing summarized conditions for executing preliminary discharge before starting the printing operation of a succeeding sheet according to the third embodiment;

FIG. 12 is a table showing summarized conditions for executing preliminary discharge before starting the printing operation of a succeeding sheet according to the fourth embodiment; and FIG. 13 is a table showing the type of preliminary discharge and an execution timing according to the fourth embodiment.

DESCRIPTION OF THE EMBODIMENTS

Embodiments of the present invention will be described below in detail with reference to the accompanying drawings.

First Embodiment

Figure 1:
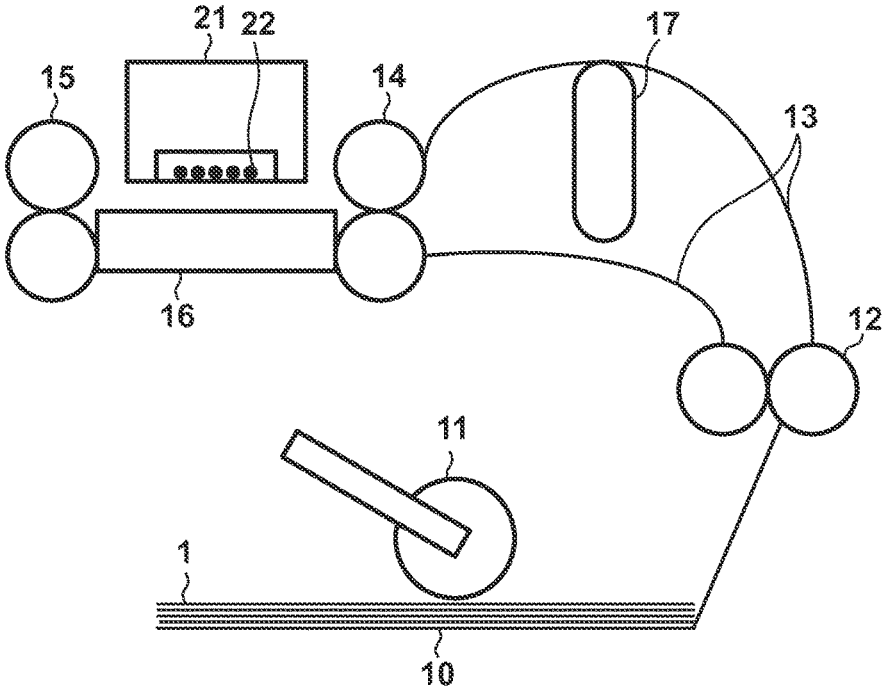
FIG. 1 is a view showing the arrangement of an inkjet printing apparatus according to the first embodiment of the present invention.
Figure 2:
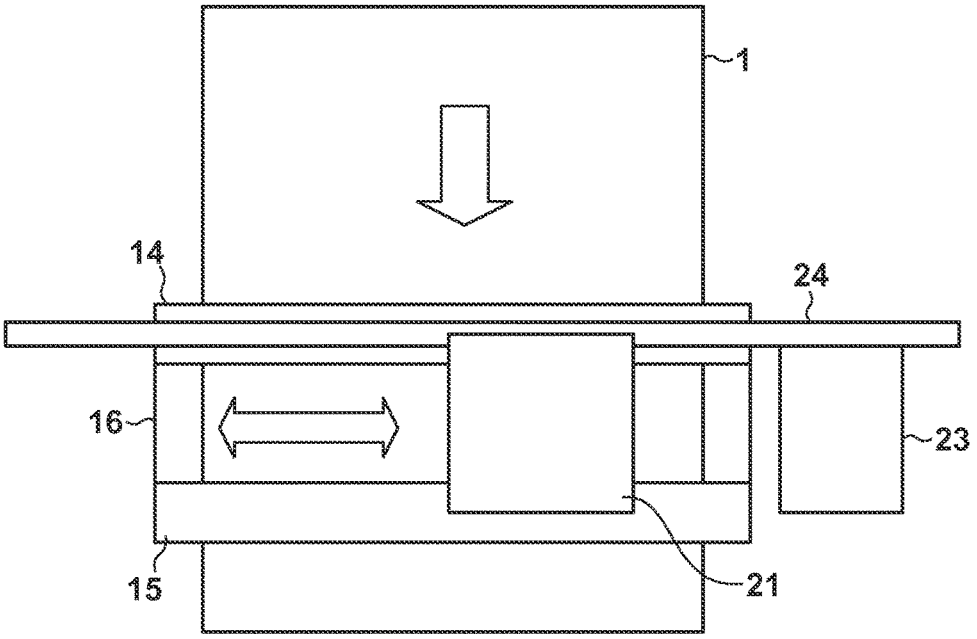
FIG. 2 is a view showing the arrangement of the inkjet printing apparatus according to the first embodiment of the present invention.

FIGS. 1 and 2 are views showing the arrangement of an inkjet printing apparatus capable of printing images on a plurality of printing sheets by continuously feeding the printing sheets according to the first embodiment of the present invention. FIG. 1 is a view schematically showing a section in a printing sheet conveyance direction.

A plurality of printing sheets 1 are stacked on a feeding tray 10 (stacking unit). The top printing sheet 1 stacked on the feeding tray 10 is picked up by a pickup roller 11 and fed toward the downstream side of a sheet conveyance direction by feeding rollers 12. Then, conveyance rollers 14 convey the printing sheet 1 to a position facing a printhead 22, and printing is performed on the printing sheet 1 by discharging ink from the printhead 22. After that, the printing sheet 1 is discharged outside the apparatus by discharge rollers 15.

A platen 16 supports the reverse surface of the printing sheet 1 at the position facing the printhead 22. A carriage 21 is movable in a direction intersecting the sheet conveyance direction (feeding direction) while mounting the printhead 22 thereon. A conveyance guide 13 guides the printing sheet 1 between the feeding rollers 12 and the conveyance rollers 14. A sheet pressing lever 17 can make the leading edge of the succeeding sheet overlap the trailing edge of the preceding sheet.

FIG. 2 is a view schematically showing a positional relationship when viewed from the upper surface of the printing sheet. It is possible to move the carriage 21 to a position facing a cap 23 and perform preliminary discharge from the printhead 22 while performing printing on the printing sheet 1 by reciprocating the carriage 21 along a guide 24.

Figure 3:
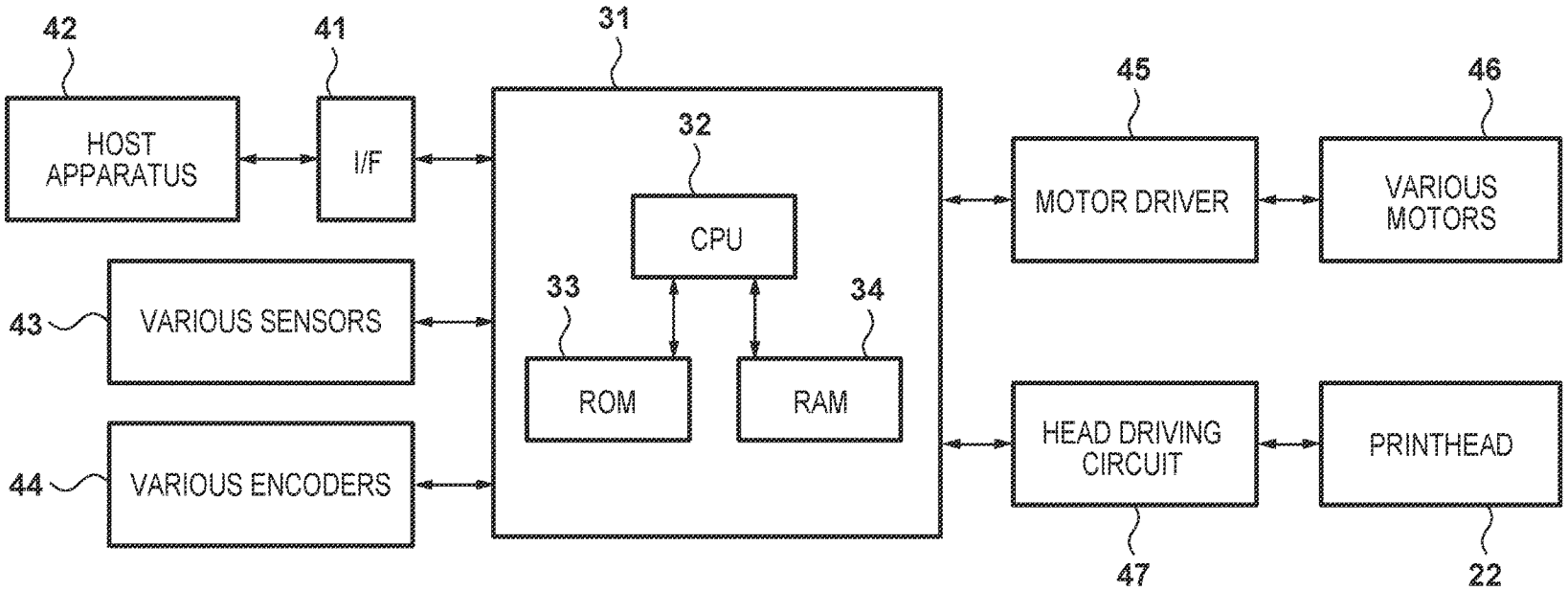
FIG. 3 is a block diagram showing the system arrangement of the inkjet printing apparatus.

FIG. 3 is a block diagram showing a system arrangement centered on a controller in the inkjet printing apparatus. A controller 31 includes a CPU 32 which performs control, a RAM 34 which temporarily stores data at the time of control, and a ROM 33 which stores a control program. The controller 31 is connected to a host apparatus 42 via an I/F 41, and receives printing image data (printing data), the attribute information of a printing image, and the like from the host apparatus 42.

The controller 31 is connected to various sensors 43 and can obtain sensor signals. The controller 31 is also connected to various encoders 44 and can detect, for example, the position of the carriage 21. The controller 31 is further connected to a motor driver 45 and a head driving circuit 47. The controller 31 drives, by sending a command to the motor driver 45, various motors 46 which operate the pickup roller 11, the feeding rollers 12, the conveyance rollers 14, the discharge rollers 15, the carriage 21, and the like. Also the controller 31 discharges ink from the printhead 22 by sending a command to the head driving circuit 47. The controller 31 can control a printing operation and preliminary discharge (maintenance operation) by combining driving operations of the various motors 46 and ink discharge from the printhead 22.

Figure 4:
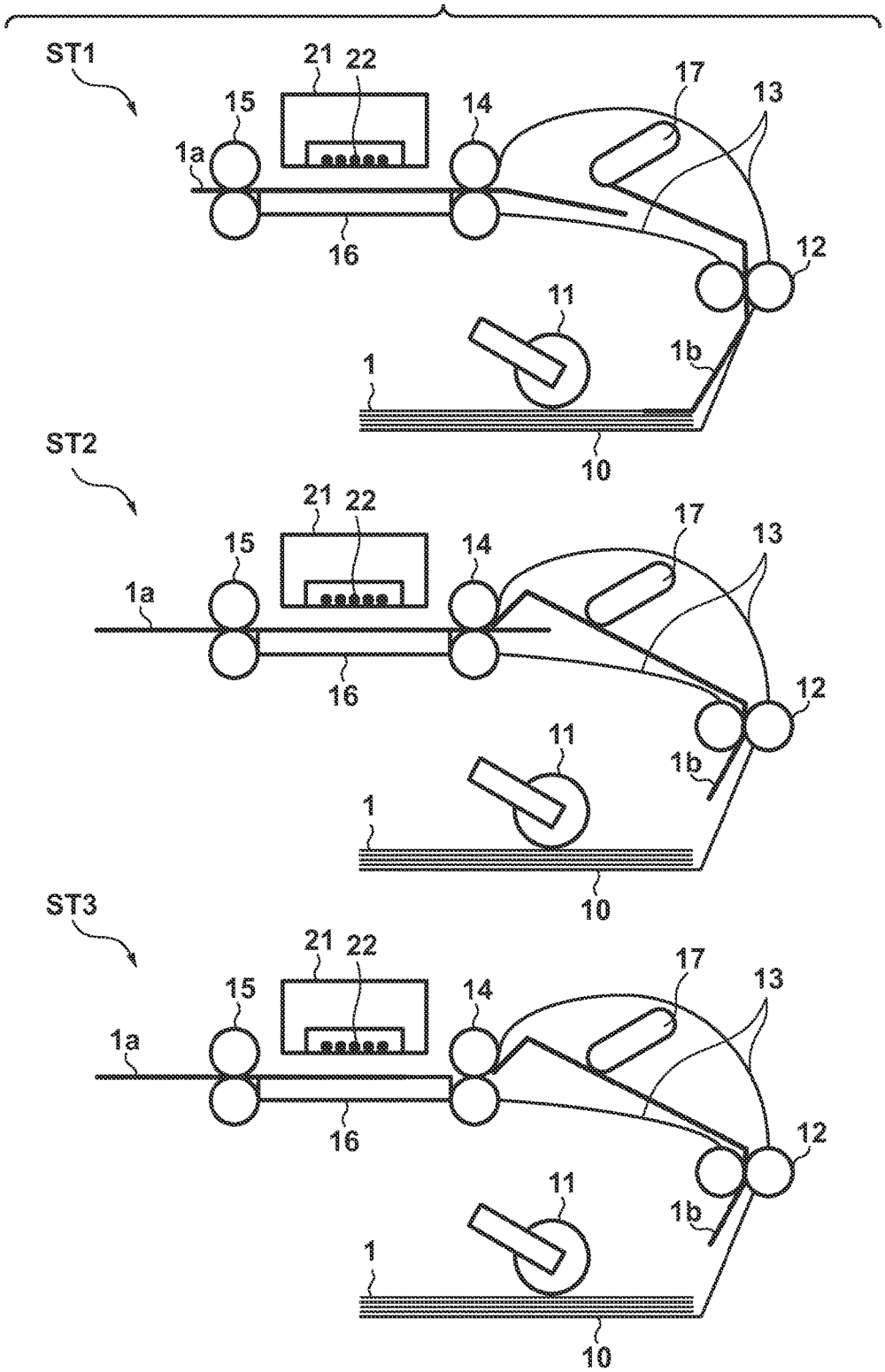
FIG. 4 is a view showing the feeding operation of a succeeding sheet.
Figure 5:
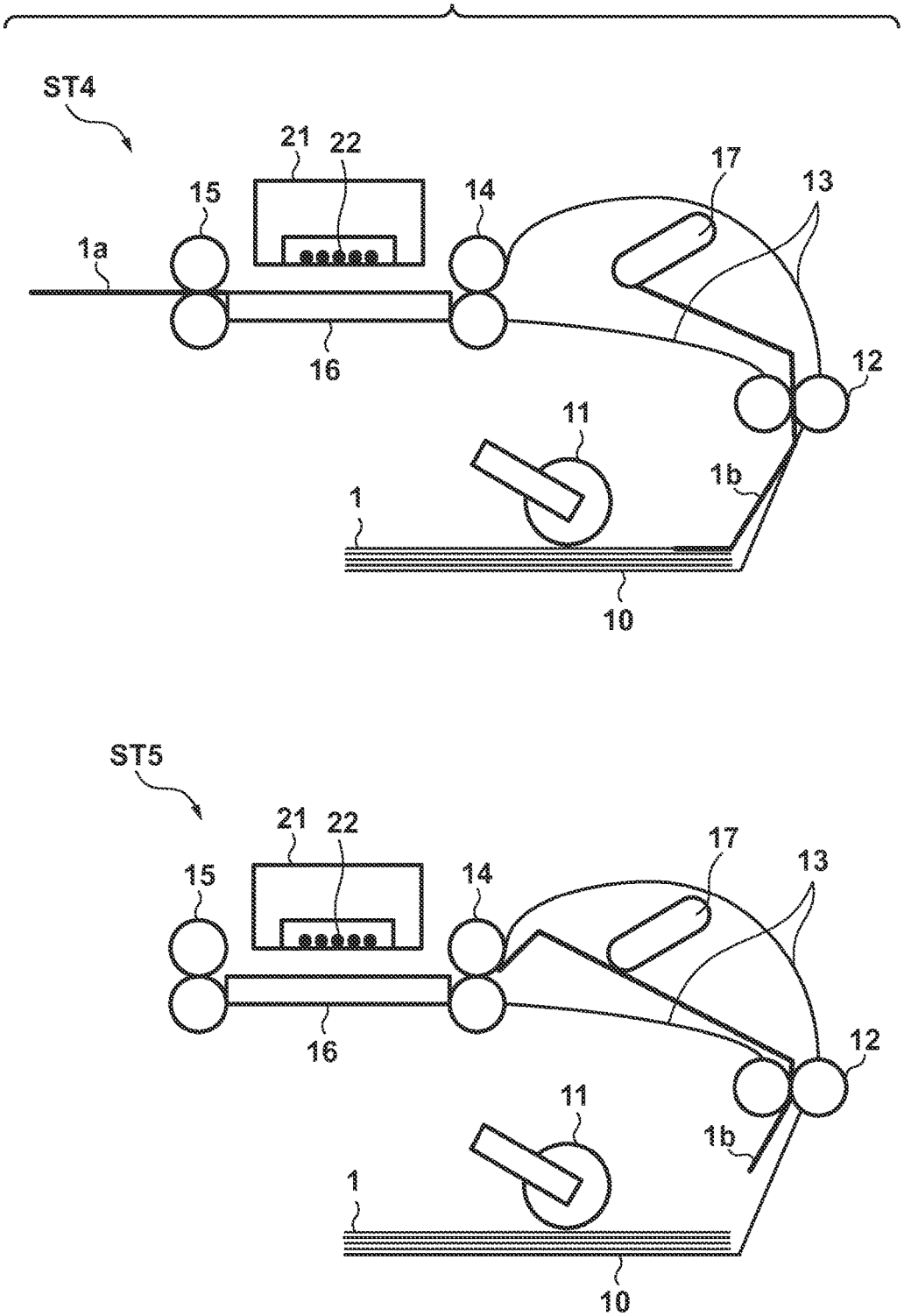
FIG. 5 is a view showing the feeding operation of the succeeding sheet.

FIGS. 4 and 5 show the feeding operation of the succeeding sheet in the inkjet printing apparatus.

During the printing operation of a preceding sheet 1*a*, the pickup roller 11 and the feeding rollers 12 are rotated, thereby moving a succeeding sheet 1*b* at high speed. This makes it possible to form an overlapping state in which, as shown in ST1 of FIG. 4, the trailing edge of the preceding sheet 1*a* and the leading edge of the succeeding sheet 1*b* overlap with each other. Then, the feeding rollers 12 are rotated when the conveyance rollers 14 are stopped, thereby performing the skew correction operation of the succeeding sheet 1*b* by abutting the leading end of the succeeding sheet 1*b* against the conveyance rollers 14. After the end of the printing operation for the preceding sheet 1*a*, the succeeding sheet 1*b* can be aligned while maintaining the overlapping state by rotating the conveyance rollers 14, as shown in ST2 of FIG. 4.

The succeeding sheet 1*b* can be aligned while maintaining the overlapping state as shown in ST2 of FIG. 4 only if a predetermined condition is satisfied. The predetermined condition is that, for example, predetermined non-printing regions (margins) or more exist in the trailing end of the preceding sheet 1*a* and the leading end of the succeeding sheet 1*b*. If the predetermined condition is not satisfied, the overlapping state is formed as shown in ST1 of FIG. 4, and then the conveyance rollers 14 and the discharge rollers 15 are rotated after the end of the printing operation of the preceding sheet 1*a* to discharge the preceding sheet 1*a*, thereby canceling the overlapping state. After that, the skew correction operation of the succeeding sheet 1*b* is performed and, as shown in ST3 of FIG. 4, the succeeding sheet 1*b* is aligned in a state in which overlapping is canceled.

On the other hand, if the type of sheet with high rigidity is designated as the attribute information of the printing image from the host apparatus 42, the trailing end of the preceding sheet 1*a* and the leading end of the succeeding sheet 1*b* abut against each other, and the overlapping state may not be formed properly. Therefore, the overlapping state as shown in ST1 of FIG. 4 is not formed. In this case, the conveyance rollers 14 and the discharge rollers 15 are rotated after the end of the printing operation of the preceding sheet 1*a* to start discharging the preceding sheet 1*a*, and then the pickup roller 11 and the feeding rollers 12 are rotated, thereby feeding the succeeding sheet as shown in ST4 of FIG. 5. After that, the skew correction operation of the succeeding sheet 1*b* is performed and, as shown in ST5 of FIG. 5, the succeeding sheet 1*b* is aligned.

As shown in ST4 of FIG. 5, if the succeeding sheet 1*b* is fed after the start of discharging the preceding sheet 1*a*, it takes time from the end of the printing operation (completion of printing) of the preceding sheet 1*a* to the start of printing operation (start of printing) of the succeeding sheet 1*b*. Since ink discharge by the printing operation is not performed during this period, a discharge failure may occur due to evaporation of water or the like. To prevent this, preliminary discharge is executed before starting the printing operation of the succeeding sheet 1*b*. The type of preliminary discharge executed here is the first preliminary discharge which discharges a relatively large amount of ink. Executing the first preliminary discharge makes it possible to prevent the discharge failure in the printing operation even if it takes time from the end of the printing operation of the preceding sheet 1*a* to the start of printing operation of the succeeding sheet 1*b*. As described above, the carriage 21 needs to be moved to the position facing the cap 23 when executing preliminary discharge. When the carriage 21 is away from the cap 23 as shown in FIG. 6 at the end of the printing operation (at the completion of printing) of the preceding sheet 1*a*, it takes time to move the carriage 21 for preliminary discharge.

On the other hand, as shown in ST1 of FIG. 4, if the succeeding sheet 1*b* is fed while forming the overlapping state between the trailing edge of the preceding sheet 1*a* and the leading edge of the succeeding sheet 1*b*, a time required from the end of the printing operation of the preceding sheet 1*a* to the start of the printing operation of the succeeding sheet 1*b* is extremely short. That is, a time in which ink discharge by the printing operation is not performed is also short and is sufficiently shorter than a preliminary discharge interval during a printing operation to be described later (in the middle of the printing operation). Therefore, the first preliminary discharge before starting the printing operation of the succeeding sheet 1*b* may not necessarily be executed. When the carriage 21 is away from the cap 23 as shown in FIG. 6 at the end of the printing operation of the preceding sheet 1*a*, the movement of the carriage 21 to the position facing the cap 23 can be omitted by omitting the execution of preliminary discharge. A time required to move the carriage 21 to the position facing the cap 23 and execute the first preliminary discharge is longer than a time required to feed the succeeding sheet 1*b* by a method shown in ST1 of FIG. 4. Therefore, omitting the execution of the first preliminary discharge makes it possible to further shorten the time required from the end of the printing operation of the preceding sheet 1*a* to the start of the printing operation of the succeeding sheet 1*b*.

As described above, in this embodiment, the succeeding sheet 1*b* is fed while forming the overlapping state and preliminary discharge before starting the printing operation of the succeeding sheet 1*b* is omitted. This makes it possible to shorten the time required from the end of the printing operation of the preceding sheet 1*a* to the start of the printing operation of the succeeding sheet 1*b* without causing any discharge failure. It is therefore possible to shorten a time required to complete printing the images on the plurality of sheets.

FIG. 7 is a table showing summarized conditions for executing preliminary discharge before starting the printing operation of the succeeding sheet 1*b* according to this embodiment. If the succeeding sheet 1*b* is fed while forming the overlapping state between the trailing edge of the preceding sheet 1*a* and the leading edge of the succeeding sheet 1*b*, preliminary discharge before starting the printing operation of the succeeding sheet 1*b* is omitted. If the succeeding sheet 1*b* is fed after the start of discharging the preceding sheet 1*a*, the first preliminary discharge is executed before starting the printing operation of the succeeding sheet 1*b*.

FIG. 8 is a table showing the types of preliminary discharge executed during the printing operation and execution timings according to this embodiment. If the printing operation continues for a long time (if a continuous printing time is long), an ink density difference, the stains of ink orifices, and the like caused by a difference in the frequency of use for each ink orifice may be accumulated. To prevent these, during the printing operation, a time elapsed since the first preliminary discharge was executed last time is determined and the first preliminary discharge is executed each time the first time elapsed. This makes it possible to prevent the discharge failure even if the printing operation continues for a long time (the first time or more). When preliminary discharge is performed during the printing operation, ink is discharged while moving the carriage 21 in a direction approaching the cap 23 to perform printing on the sheet 1, and then the carriage 21 is moved to the position facing the cap 23.

The second preliminary discharge is also executed for each second time shorter than the first time during the printing operation. The second preliminary discharge is a preliminary discharge operation in which a smaller amount of ink is discharged than in the first preliminary discharge. Executing the second preliminary discharge at a relatively short interval makes it possible to increase the stability of ink discharge in the printing operation. If the first preliminary discharge has been executed during the printing operation, the second preliminary discharge is executed after the second time has elapsed since the first preliminary discharge was executed. That is, the second preliminary discharge is executed each time the second time has elapsed since the first preliminary discharge or the second preliminary discharge was executed last time.

As described above, according to this embodiment, it is possible to shorten the time required to complete printing the images on the plurality of sheets without causing any discharge failure.

Second Embodiment

The second embodiment of the present invention will be described below with reference to the accompanying drawings. Note that the basic part, i.e. the arrangement of an inkjet printing apparatus, is the same as in the first embodiment, and thus a description thereof will be omitted but only a characteristic arrangement will be described.

In the first embodiment, whether to execute preliminary discharge before starting the printing operation for the succeeding sheet 1*b* has been determined depending on whether to feed the succeeding sheet 1*b* while forming the overlapping state between the trailing edge of the preceding sheet 1*a* and the leading edge of the succeeding sheet 1*b*. On the other hand, in the second embodiment, a time (to be referred to as a non-printing time hereinafter) required from the end of the printing operation of a preceding sheet 1*a* to the start of a printing operation for the succeeding sheet 1*b* is estimated by a method shown in FIG. 9, and whether to execute preliminary discharge before starting the printing operation for the succeeding sheet 1*b* is determined.

Figure 9:
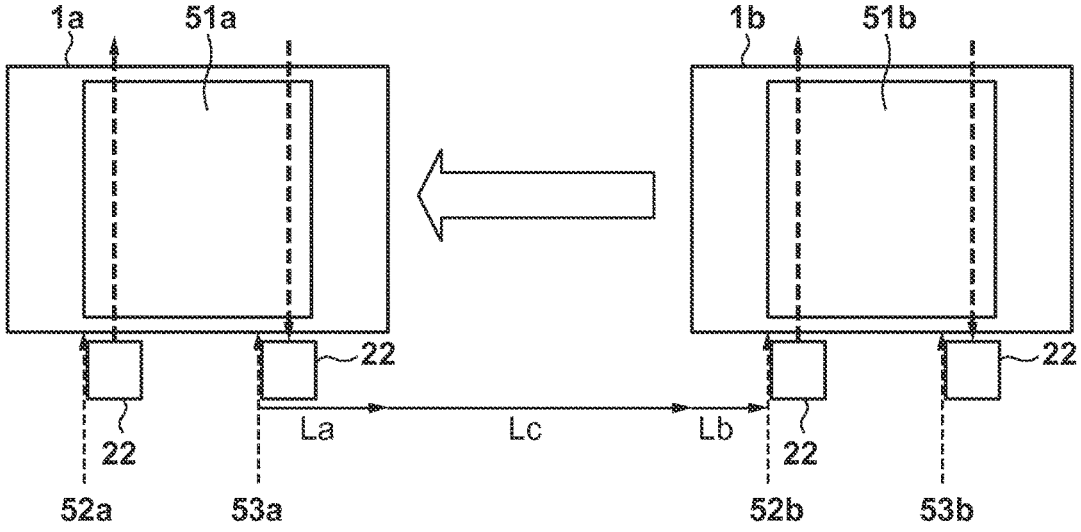
FIG. 9 is a view schematically showing a time required to discharge a preceding sheet and feed the succeeding sheet.

FIG. 9 is a view schematically showing a time required to discharge the preceding sheet 1*a* and feed the succeeding sheet 1*b*. In FIG. 9, regions where printing is performed on the preceding sheet 1*a* and the succeeding sheet 1*b* are indicated by a region 51*a* and a region 51*b*, respectively. At this time, positions where a printhead 22 (an end portion on a sheet conveyance downstream side) passes on the preceding sheet 1*a* and the succeeding sheet 1*b* when the printing operations for the respective sheets start are indicated by a position 52*a* and a position 52*b*. Similarly, positions where the printhead 22 (the end portion on the sheet conveyance downstream side) passes on the preceding sheet 1*a* and the succeeding sheet 1*b* when the printing operations for the respective sheets end are indicated by a position 53*a* and a position 53*b*. Then, a conveyance amount from the position 53*a* to a position where the trailing end of the preceding sheet 1*a* is discharged is indicated by La in FIG. 9. Also a conveyance amount from a position where the leading end of the succeeding sheet 1*b* is fed onto a platen 16 to the position 52*b* is indicated by Lb in FIG. 9.

On the other hand, Lc in FIG. 9 indicates a distance from the trailing end of the preceding sheet 1*a* on the feeding and conveyance path of a printing sheet 1 to the leading end of the succeeding sheet 1*b*. If the distance varies, a maximum value thereof is set to Lc. If the succeeding sheet 1*b* is aligned while maintaining the overlapping state as shown in ST2 of FIG. 4, assume that Lc takes a negative value.

With the above-described La, Lb, and Lc, a non-printing time Tn can be estimated as:

$$Tn=(La+Lb)\times K1+Lc\times K2$$

(where K1 is a coefficient which converts the conveyance amount into a time and K2 is a coefficient which converts the distance into a time).

By comparing the non-printing time Tn with a threshold time Ta in this way, whether to execute preliminary discharge before starting the printing operation for the succeeding sheet 1*b* is determined. FIG. 10 is a table showing summarized conditions for executing preliminary discharge before starting the printing operation of a succeeding sheet 1*b* according to the second embodiment. If the non-printing time Tn is equal to or shorter than the threshold time Ta, a time in which ink discharge by the printing operation is not performed is also relatively short. In a case in which this condition is applied, preliminary discharge before starting the printing operation of the succeeding sheet 1*b* is omitted. In other cases, preliminary discharge is executed before starting the printing operation of the succeeding sheet 1*b*.

According to the second embodiment, it is possible to omit preliminary discharge before starting the printing operation of the succeeding sheet 1*b* depending on the non-printing time irrespective of whether to form the overlapping state between the trailing edge of the preceding sheet 1*a* and the leading edge of the succeeding sheet 1*b*.

Third Embodiment

The third embodiment of the present invention will be described below with reference to the accompanying drawings. Note that the basic part, i.e. the arrangement of an inkjet printing apparatus, is the same as in the first embodiment, and thus a description thereof will be omitted but only a characteristic arrangement will be described.

In the first embodiment, whether to execute preliminary discharge before starting the printing operation for the succeeding sheet 1*b* has been determined depending on whether to feed the succeeding sheet 1*b* while forming the overlapping state between the trailing edge of the preceding sheet 1*a* and the leading edge of the succeeding sheet 1*b*. On the other hand, in the third embodiment, whether to execute preliminary discharge before starting a printing operation for a succeeding sheet 1*b* is determined by, in addition to this condition, the positional relationship between a carriage 21 and a cap 23 at the end of a printing operation for a preceding sheet 1*a*.

If the carriage 21 is close to the cap 23 at the end of the printing operation of the preceding sheet 1*a*, it does not take time to move the carriage 21 for preliminary discharge. A time required to execute the first preliminary discharge is sufficiently shorter than a time required to feed the succeeding sheet 1*b* by the method shown in ST1 of FIG. 4. For this reason, if the carriage 21 is close to the cap 23, there is hardly any change in a time required from the end of the printing operation of the preceding sheet 1*a* to the start of the printing operation of the succeeding sheet 1*b* even if the first preliminary discharge is executed. The number of executions of preliminary discharge during the printing operation can sometimes be decreased, and thus the first preliminary discharge is executed before starting the printing operation of the succeeding sheet 1*b*.

FIG. 11 is a table showing summarized conditions for executing preliminary discharge before starting the printing operation of a succeeding sheet 1*b* according to this embodiment. If the succeeding sheet 1*b* is fed while forming the overlapping state between the trailing edge of the preceding sheet 1*a* and the leading edge of the succeeding sheet 1*b* and if the carriage 21 is away from the cap 23 at the end of the printing operation of the preceding sheet 1*a*, preliminary discharge before starting the printing operation of the succeeding sheet 1*b* is omitted. If the carriage 21 is close to the cap 23 at the end of the printing operation of the preceding sheet 1*a* or if the succeeding sheet 1*b* is fed after the start of discharging the preceding sheet 1*a*, the first preliminary discharge is executed before starting the printing operation of the succeeding sheet 1*b*.

In general, the carriage 21 is away from the cap 23 at the end of the printing operation of the preceding sheet 1*a* when the final movement of the carriage 21 in the printing operation for the preceding sheet 1*a* is in the direction away from the cap 23. Therefore, whether the carriage 21 is away from the cap 23 at the end of the printing operation of the preceding sheet 1*a* may be determined by the final moving direction of the carriage 21 in the printing operation of the preceding sheet 1*a*. At this time, if the aforementioned moving direction is the direction away from the cap 23, it is determined that the carriage 21 is away from the cap 23 at the end of the printing operation of the preceding sheet 1*a*. On the other hand, if the moving direction is the direction approaching the cap 23, it is determined that the carriage 21 is close to the cap 23 at the end of the printing operation of the preceding sheet 1*a*.

According to the execution timings of preliminary discharge during the printing operation shown in FIG. 8, if the first preliminary discharge is executed before starting the printing operation, the execution timing of the following second preliminary discharge is delayed as compared with a case in which the first preliminary discharge is not executed. At this time, the number of executions of preliminary discharge during the printing operation may be decreased. As described above, if the carriage 21 is close to the cap 23 at the end of the printing operation of the preceding sheet 1*a*, there is hardly any change in the time required from the end of the printing operation of the preceding sheet 1*a* to the start of the printing operation of the succeeding sheet 1*b* even if the first preliminary discharge is executed before starting the printing operation. On the other hand, if the carriage 21 is moved to the cap 23 during the printing operation and the first preliminary discharge is executed, a time required for the printing operation increases. For these reasons, it is possible to shorten the time required for the printing operation by executing preliminary discharge before starting the printing operation to decrease the number of executions of preliminary discharge during the printing operation as much as possible if the carriage 21 is close to the cap 23 at the end of printing operation of the preceding sheet 1*a*.

Fourth Embodiment

The fourth embodiment of the present invention will be described below with reference to the accompanying drawings. Note that the basic part, i.e. the arrangement of an inkjet printing apparatus, is the same as in the first embodiment, and thus a description thereof will be omitted but only a characteristic arrangement will be described.

In the first embodiment, during the printing operation, the first preliminary discharge has been executed each time the first time has elapsed since the first preliminary discharge was executed last time. On the other hand, in the fourth embodiment, the first preliminary discharge is executed before starting a printing operation for the next printing sheet when the first time has elapsed since the first preliminary discharge was executed last time.

FIG. 12 is a table showing summarized conditions for executing preliminary discharge before starting the printing operation of a succeeding sheet 1*b* according to the fourth embodiment. If the first time has elapsed since the first preliminary discharge was executed, the first preliminary discharge is executed before starting the printing operation. If the first time has not elapsed, preliminary discharge before starting the printing operation is omitted.

FIG. 13 is a table showing the type of preliminary discharge executed during the printing operation and an execution timing according to the fourth embodiment. Unlike in FIG. 8, the first preliminary discharge is not executed during the printing operation even if the first time has elapsed since the first preliminary discharge was executed. In this case, the first preliminary discharge is executed before starting the printing operation for the next printing sheet.

According to the fourth embodiment, the first preliminary discharge which takes relatively long time to execute is executed only before starting the printing operation. It is therefore possible to execute the first preliminary discharge after the elapse of the first time without making hardly any change in a time required to complete printing images on a plurality of sheets.

Other Embodiments

The feeding method of the succeeding sheet has been described above in the four embodiments. However, the feeding method of the succeeding sheet is not limited to the method described above. An arrangement in which, for example, the feeding method of forming the overlapping state between the trailing edge of the preceding sheet 1*a* and the leading edge of the succeeding sheet 1*b* as shown in ST1 of FIG. 4 cannot be executed may be adopted. Further, in the above-described embodiments, preliminary discharge has been omitted before starting the printing operation of the succeeding sheet 1*b*. However, maintenance to be omitted is not limited to preliminary discharge. For example, a print-head recovery operation other than preliminary discharge such as an operation of wiping the stains of ink orifices may be omitted. Furthermore, in the above-described embodiments, the type of preliminary discharge executed and the execution timing have been described. However, they are not limited to the above-described type and timing. For example, three or more types of preliminary discharge may be executed during a printing operation. A determination unit configured to determine whether to execute preliminary discharge may be different from the unit described above. For example, preliminary discharge is executed not by determining the elapse of time since preliminary discharge was executed last time but when the conveyance amount of a printing sheet by the printing operation or the like reaches a predetermined amount.

In the second embodiment, the non-printing time has been estimated by the method shown in FIG. 9. However, the estimation method of the non-printing time is not limited to this. For example, a time from the completion of a printing operation for a preceding sheet 1*a* to the completion of the skew correction operation of a succeeding sheet 1*b* is measured, and by using this as the non-printing time, whether to execute preliminary discharge before starting a printing operation for the succeeding sheet 1*b* may be determined.

The embodiments have been described above by using the inkjet printing apparatus. However, a printing method is not limited to an inkjet printing method.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-166999, filed Aug. 19, 2014, which is hereby incorporated by reference herein in its entirety.

What is claimed is:

1. A printing apparatus comprising:

a feeding unit configured to feed a printing sheet;

a conveyance unit configured to convey the printing sheet fed by the feeding unit;

a print-head configured to print on the printing sheet conveyed by the conveyance unit by discharging ink;

a conveyance control unit configured to control conveyance of printing sheets to form an overlap state in which a trailing edge of a preceding sheet as the printing sheet precedingly fed and a leading edge of a succeeding sheet as the printing sheet succeedingly fed following the preceding sheet overlap each other; and a preliminary discharge control unit configured to control the print-head to execute a preliminary discharge operation in which ink that does not contribute to printing is discharged between a completion of printing on the preceding sheet and a start of printing on the succeeding sheet, wherein the preliminary discharge control unit controls the print-head to execute the preliminary discharge operation in a case that the overlap state is not formed between the preceding sheet and the succeeding sheet, and not to execute the preliminary discharge operation in a case that the overlap state is formed between the preceding sheet and the succeeding sheet.

2. The apparatus according to claim 1, further comprising a carriage configured to move while mounting a printhead configured to print images to the printing sheets; and a determination unit configured to determine, based on a position of said carriage at a time of the completion of printing on the preceding sheet, whether to execute a recovery operation.

3. The apparatus according to claim 2, wherein said recovery operation causes the printhead to execute preliminary discharge.

4. The apparatus according to claim 1, further comprising a time determination unit configured to determine a continuous printing time serving as a time in which a printing operation is executed continuously without executing a recovery operation; and a determination unit configured to determine, based on the continuous printing time determined by said time determination unit, whether to execute maintenance operation.

5. The apparatus according to claim 1, further comprising a time determination unit configured to determine a continuous printing time serving as a time in which a printing operation is executed continuously without executing a recovery operation, wherein if said time determination unit determines that the continuous printing time is long, a recovery operation in place of the recovery operation is executed even in a middle of a printing operation for the printing sheets.

6. A printing apparatus comprising:

a feeding unit configured to feed a printing sheet;

a print-head configured to print on the printing sheet fed by the feeding unit by discharging ink;

an estimation unit configured to estimate a time from a timing when printing on a preceding sheet as the printing sheet precedingly fed has completed to a timing when printing on a succeeding sheet as the printing sheet succeedingly fed has started; and a preliminary discharge control unit configured to control the print-head to execute a preliminary discharge operation in which ink that does not contribute to printing is discharged between a completion of printing on the preceding sheet and a start of printing on the succeeding sheet, wherein the preliminary discharge control unit controls the print-head to execute the preliminary discharge operation in a case that the time estimated by the estimation unit is longer than a predetermined time, and not to execute the preliminary discharge operation in a case that the time is not longer than the predetermined time.

7. The apparatus according to claim 6, further comprising a detection unit configured to detect a non-printing region from printing data, wherein said detection unit detects a non-printing region of the preceding sheet and a non-printing region of the succeeding sheet, and said estimation unit estimates the time from a length of the printing sheet in a feeding direction in the non-printing region of the preceding sheet and the non-printing region of the succeeding sheet.

8. A control method of a printing apparatus comprising:

feeding a printing sheet;

conveying the fed printing sheet;

printing by a print-head on the conveyed printing sheet by discharging ink;

controlling conveyance of printing sheets to form an overlap state in which a trailing edge of a preceding sheet as the printing sheet precedingly fed and a leading edge of a succeeding sheet as the printing sheet succeedingly fed following the preceding sheet overlap each other; and controlling the print-head to execute a preliminary discharge operation in which ink that does not contribute to printing is discharged between a completion of printing on the preceding sheet and a start of printing on the succeeding sheet, wherein the print-head is controlled to execute the preliminary discharge operation in a case that the overlap state is not formed between the preceding sheet and the succeeding sheet, and not to execute the preliminary discharge operation in a case that the overlap state is formed between the preceding sheet and the succeeding sheet.

9. A control method of a printing apparatus comprising:

feeding a printing sheet;

printing by a print-head on the fed printing sheet by discharging ink;

estimating a time from a timing when printing on a preceding sheet as the printing sheet precedingly fed has completed to a timing when printing on a succeeding sheet as the printing sheet succeedingly fed has started; and controlling the print-head to execute a preliminary discharge operation in which ink that does not contribute to printing is discharged between a completion of printing on the preceding sheet and a start of printing on the succeeding sheet, wherein the print-head is controlled to execute the preliminary discharge operation in a case that the time estimated is longer than a predetermined time, and not to execute the preliminary discharge operation in a case that the time is not longer than the predetermined time.

* * * * *